United States Patent [19]

Simpson

[11] 4,095,070

[45] June 13, 1978

[54] MINIATURE PUSHBUTTON SWITCH

[75] Inventor: Kenneth A. Simpson, Lynnfield, Mass.

[73] Assignee: C & K Components, Inc., Watertown, Mass.

[21] Appl. No.: 754,848

[22] Filed: Dec. 27, 1976

[51] Int. Cl.[2] ..... H01H 3/00

[52] U.S. Cl. ..... 200/153 J; 200/67 G; 200/159 R; 200/67 D

[58] Field of Search ..... 200/67 D, 67 G, 86.5, 200/68, 153 J, 153 K, 159 R

[56] References Cited

U.S. PATENT DOCUMENTS

| | | | |
|---|---|---|---|
| 2,524,410 | 10/1950 | Trainor | 200/153 J X |
| 2,623,960 | 12/1952 | Haydon | 200/153 J X |
| 2,633,510 | 3/1953 | Schellman | 200/68 |
| 3,051,810 | 8/1962 | Wahltrom | 200/153 J |
| 3,321,983 | 5/1967 | Stevens | 200/153 J X |
| 3,502,833 | 3/1970 | Rossini et al. | 200/86.5 |
| 3,619,528 | 11/1971 | Sorenson | 200/153 J |
| 3,746,809 | 7/1973 | Gaber | 200/67 G |
| 3,789,173 | 1/1974 | Bury | 200/153 J |
| 3,878,347 | 4/1975 | Roeser | 200/67 D |
| 4,022,999 | 5/1977 | Brown | 200/67 G |

FOREIGN PATENT DOCUMENTS

| | | | |
|---|---|---|---|
| 797,781 | 7/1958 | United Kingdom | 200/153 T |

*Primary Examiner*—Bruce A. Reynolds
*Assistant Examiner*—Mark Paschall
*Attorney, Agent, or Firm*—Weingarten, Maxham & Schurgin

[57] ABSTRACT

A pushbutton switch having a contact movable to either of two operating positions. In the alternate action configuration, a leaf spring, acting upon a pivot block, retains the contact in either of its stable positions, permitting the pushbutton to sequentially actuate the switch to one of its operating positions each time it is pushed and released. In the alternative momentary configuration, an additional compression spring returns the switch to the first operating position whenever the pushbutton is released. Either configuration may be constructed as a single pole or as a double pole switch.

16 Claims, 5 Drawing Figures

MINIATURE PUSHBUTTON SWITCH

FIELD OF THE INVENTION

This invention relates generally to switches and is more particularly concerned with a miniature push-on, push-off switch of relatively shallow configuration and high amperage rating.

DISCUSSION OF THE PRIOR ART

Many types of pushbutton switches of the alternate action type have been available prior to this invention. Such switches are normally substantially longer or have a substantially greater depth than other conventional types such as toggle or slide switches. Furthermore, the amperage which can be switched by such device is generally relatively limited because of the prior art constructions. In addition, the prior art switches generally are either alternate action or momentary but the same construction cannot normally be used for both modes with only a very minor modification.

Several examples of the prior art pushbutton switches are shown in U.S. Pat. Nos. 3,789,173, 3,619,528, 3,321,983, 3,051,810, 2,633,510, and 2,623,960. An example of a switch which employs a contoured leaf spring or blade operating in a manner substantially different from the present invention is shown in U.S. Pat. No. 3,878,347.

SUMMARY OF THE INVENTION

Broadly speaking, this invention is concerned with a pushbutton or push-on, push-off switch which may be constructed for use either in an alternate action or a momentary mode. In the alternate action configuration, a contoured leaf spring retains a pivot block within the body of the switch in either of two stable positions. A fulcrum or movable contact, whose position is controlled by the pivot block, makes the electrical connection between the switch contacts which extend outwardly for external connection. A pivot pin is actuated by a plunger to operate the pivot block through the leaf spring.

Because the leaf spring is employed for purposes of positioning the electrically insulative pivot block, there is no restriction on the amperage rating of the switch due to the size requirements of the spring. The fulcrum contact may be made more massive as desired to draw the necessary amperage for each particular use. Because of the construction of the switch and the action of the leaf spring in conjunction with the pivot block, the height or depth of the switch behind a mounting panel is substantially less than a typical prior art pushbutton switch of similar type. This is achieved with an appropriate snap action "feel", since it is not just a butt contact. The leaf spring provides over-center snap action but the force to actuate it is substantially the same as for the prior art switches. Thus the switch of this invention enables the switching of higher amperage with a smaller switch having external actuating characteristics similar to prior art switches.

BRIEF DESCRIPTION OF THE DRAWING

The objects, advantages and features of this invention will be more clearly appreciated from the following detailed description when taken in conjunction with the accompanying drawing in which.

DETAILED DESCRIPTION OF THE PREFERRED EMBODIMENTS

Figure 1:
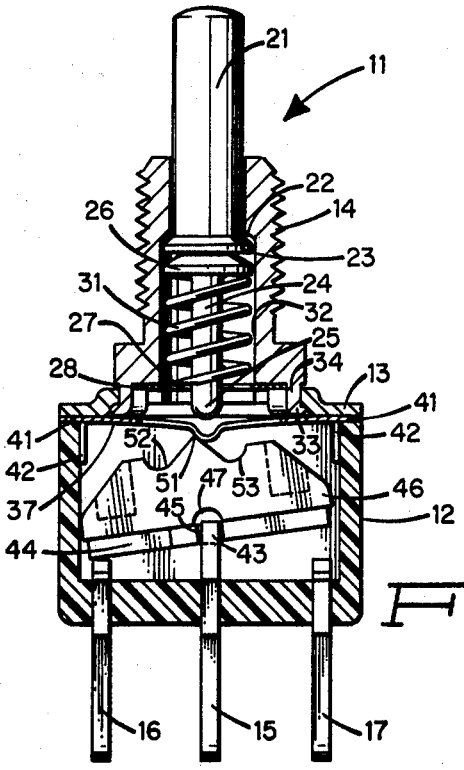
FIG. 1 is a cross-sectional view of one embodiment of the switch of this invention.
Figure 2:
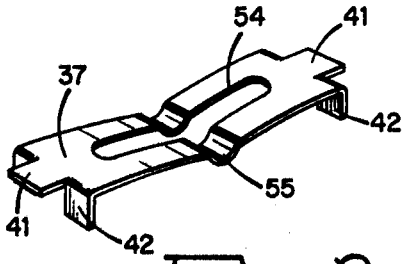
FIG. 2 is a perspective view of the leaf spring used in the switch of FIG. 1.
Figure 4:
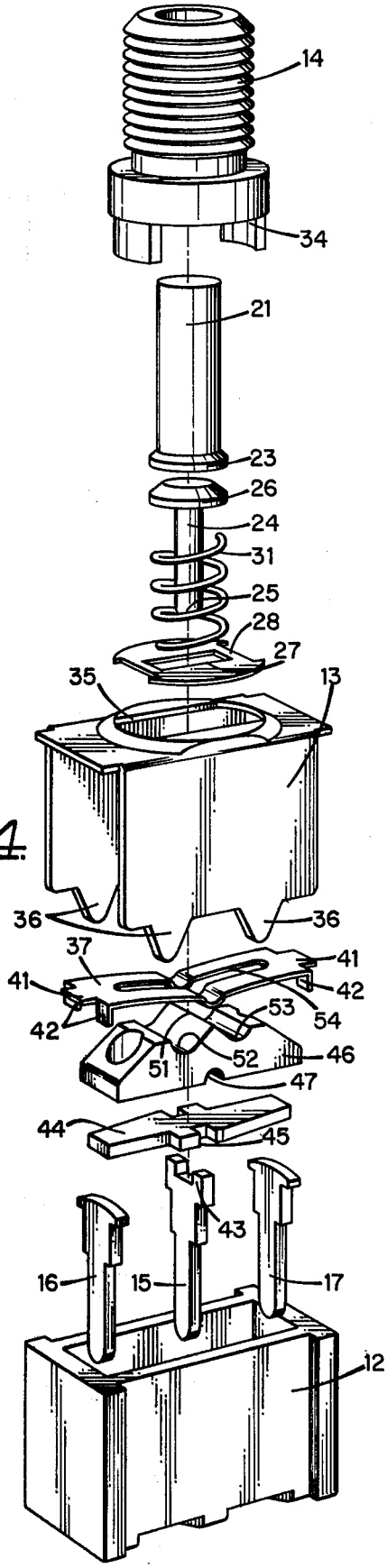
FIG. 4 is a perspective exploded view of the components comprising the switch of FIG. 1.

With reference now to the drawing and more particularly to FIGS. 1, 2 and 4 thereof, there is shown a switch 11 comprising an insulative case 12, a normally metal housing 13 which encloses two sides and the top of the case, and a normally metal bushing 14, connected to the housing. These three elements together comprise the overall, static envelope or housing of the switch.

Extending from the bottom of case 12 are electrical center terminal 15 and end terminals 16 and 17 on either side thereof. Projecting upwardly through bushing 14 is plunger 21 which is captured within the bushing by shoulder 22 in conjunction with enlarged annular end 23 of the plunger. Beneath and in contact with the bottom surface of the plunger is pivot pin 24 having a shaft with a rounded end 25 and an enlarged frusto-conically shaped upper end 26 which engages the bottom surface of the plunger. The stem of the pivot pin extends through elongated slot 27 in thin, disc-like spring retainer 28 and a return spring 31 is captured between the enlarged upper end 26 of the pivot pin and the spring retainer, all within cylindrical bore 32 in bushing 14. The ends 33 of projections 34 extending from the bushing are crimped around the inside edges of opening 35 in housing 13 to thereby secure the bushing to the housing. The housing is secured to case 12 by means of crimping tabs 36 (FIG. 4) around the bottom surface of the case. The leaf spring 37 shown in FIG. 2 is formed with end tabs 41 which are captured between the housing and the case while downwardly projecting legs 42 on either side of tabs 41 extend downwardly against the inner walls of the case. The combination of the tabs and legs not only maintain leaf spring 37 in place but provide an element of support therefor.

As shown in FIG. 4, the upper end 43 of center terminal 15 has a yoke configuration on which is balanced the movable or fulcrum contact 44 having notches 45 to accommodate the upward projection of yoke 43. Movable contact 44 is adapted to selectively bridge either of two contacts 15 and 16 or 15 and 17 depending upon the operative position of the switch at any particular moment. This contact is an electrically conductive member and may be made relatively massive to be able to handle a relatively high amperage. Resting on top of contact 44 is electrically insulative pivot block 46 having a generally truncated triangular shape with a flat base engaging contact 44. An arcuate cutout 47 is provided to accommodate the upwardly projecting portions of yoke 43 which extend through notches 45 of the fulcrum contact. Because pivot block 46 separates the electrically conductive portions of the switch from the other elements, plunger 21 may be made of any suitable material, even metal, without danger of shock to the operator.

Pivot block 46 is formed with an upwardly projecting peak 51 flanked by rounded concave depressions 52 and 53. The leaf spring is formed with a central longitudinal opening 54 and central downwardly projecting dimples 55 on either side of the slot. As may be observed from the drawing, there is normally interference contact between the peak 51 of the pivot block and dimples 55 of the leaf spring such that the pivot block is retained by the leaf spring in whatever position it has been placed at any particular time.

When it is desired to change the operative position of the switch, plunger 21 is pushed downwardly and rounded end 25 of pivot pin 24 projects through slot 54 in the leaf spring and slides down the sloping surface from peak 51 of the pivot block to rounded depression 53. As it slides into the depression, the lower end of the pivot pin swings rightward, with reference to FIG. 1, as permitted by slot 27 in spring retainer 28 and slot 54 in leaf spring 37, to cause the pivot block to rock to the right thereby making engagement between terminals 15 and 17 by means of contact 44. When the pivot block has moved to the right to change the operative status of the switch, the plunger is released and end 25 of pivot pin 24 retreats from slot 54 of the leaf spring under the influence of return spring 31. Leaf spring 37, by means of dimples 55 pressing against the sloping surface of the pivot block on the opposite side of peak 51 as shown in FIG. 1, will retain the switch in the operative condition wherein contact 44 bridges terminals 15 and 17. By again depressing the plunger, the pivot block rocks back to the left to the position shown in FIG. 1 and is likewise retained in that position by the leaf spring. Note that the conically shaped upper end of the pivot pin permits the axis of the pin to swing smoothly as necessary to enter the pivot block depressions without changing its relative length.

It should be noted that unlike many prior art devices, the spring 37, which has sufficient flexibility to enable the pivot block to move against it while retaining the block in place, has no other function. In this case, the sping need only be strong enough to handle the function of providing a snap action with respect to the pivot block and to retain it positively in the desired position. The actual bridging of two contacts is made by means of fulcrum contact 44 which may be as massive as desired in order to handle any reasonable amperage which might be required of such a switch.

Figure 3:
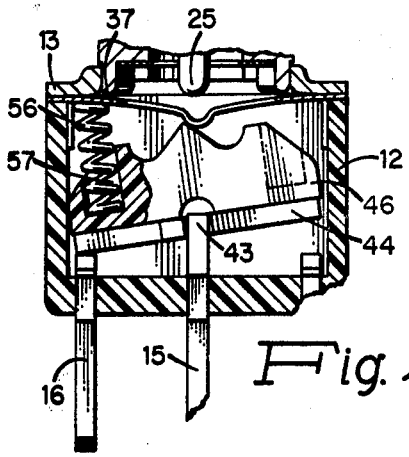
FIG. 3 is a partial sectional view similar to FIG. 1 showing the switch of this invention configured for momentary action.

The switch described above can be easily modified to be a momentary action switch as shown in FIG. 3 simply by placing a return spring 56 in one of the holes 57 formed in the pivot block. The spring extends between the bottom end of blind hole 57 and the bottom surface of leaf spring 37 (or the inside of the top of housing 13) adjacent the inside surface of one side of case 12. Each time the plunger is pressed down, the normal action as previously described will take place but when the plunger is released, spring 56 will cause the pivot block and movable contact to return to the position shown in FIGS. 1 and 3 bridging terminals 15 and 16. Thus contact between terminals 15 and 17 is momentary with such a switch but the only difference between the switch of FIG. 3 and that of FIG. 1 is the addition of return spring 56. No other components need be changed or modified, particularly since pivot block 46 may be formed with two such holes 57 for both switch configurations to be available for use as necessary and so that the pivot block need not be oriented in one direction or the other upon installation. As an alternative to the above described momentary configuration, terminals 16 may be grounded or removed entirely so that effective electrical contact is made only when plunger 21 is depressed, for strictly momentary switching, without a normal steady state electrically operative position. Of course, the normal position may still be termed an operative position of the switch, only there is no electrical connection made in that position.

Figure 5:
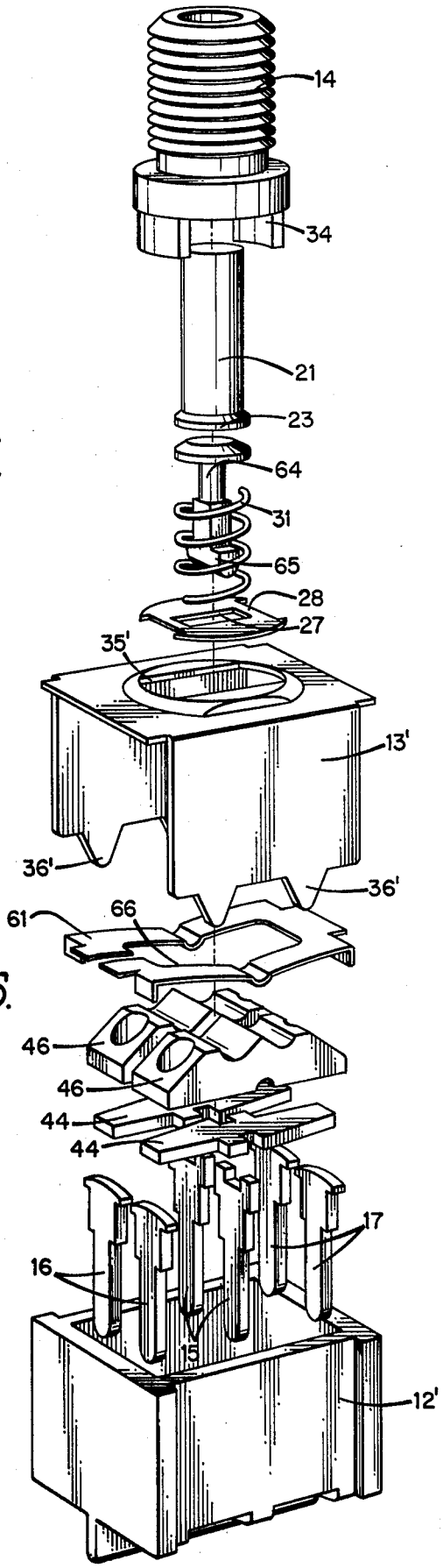
FIG. 5 is a perspective exploded view similar to FIG. 4 showing the component modifications necessary for use of the switch as a double pole device.

As seen in FIG. 5, the concept of this invention can easily be extended to a double-pole switch whereas the device previously described with respect to FIG. 1 is a single-pole double-throw switch. This configuration only requires that the switch case and housing be substantially wider to accommodate two parallel sets of terminals 15–17, a wider leaf spring 61 which is configured similarly to leaf spring 37 of FIG. 2, two pivot blocks 46 and two fulcrum contacts 44. Because contact is being made between four terminals at a time, pivot pin 64 is formed substantially as before but has a bottom T configuration 65 which is configured to extend through enlarged slot 66 in leaf spring 61 and engage the concave depressions in pivot blocks 46. Because of tolerance variations in components, leaf spring 61 is bifurcated to make the action of each side of the double-pole configuration as independent as possible. By forming the leaf spring in this manner, one side thereof does not influence the contact action or pressure of the other side to any significant degree. Even with these minor structural variations, this configuration operates in substantially the same manner as that previously described for the single-pole, double-throw switch. Note that where elements in FIG. 5 have been enlarged over those equivalent elements in FIG. 4, a prime has been added, but these components are otherwise the same as in the previously described configuration.

The bushing 14, the plunger 21 and other elements may be formed in several different configurations for specialized purposes but their shape forms no part of this invention. Furthermore, the switch itself may be mounted in a panel by known means and it is not necessary that these means be discussed in detail herein. As stated previously, the present construction permits a substantially shorter stroke for a push-on, push-off switch than was previously available, thereby reducing the behind-the-panel depth to permit greater density of equipment behind such mounting panels. Also this construction enables the switching of substantially higher amperage with the same amount of switching force or the same desired "feel" as previously available in switches which handled less current or, alternatively, would be harder to operate. The over-center snap action of this switch permits the desired positive "feel" for a switch of this type without detracting from its other characteristics.

For reference purposes, examples of the dimensions of a single-pole switch of this invention are set forth. It is to be understood that by providing such examples the scope of the invention is in no way limited. The casing and housing form a combination typically 0.5 inch (12.7 mm) wide, 0.27 inch (6.86 mm) thick and 0.375 inch (9.52 mm) high. The terminals typically project 0.156 inch (3.96 mm) outwardly from the case and the bushing and plunger extend 0.655 inch (16.63 mm) above the housing. That portion of the switch extending rearwardly from a panel, when mounted thereto, less the terminals, is typically 0.45 inch (11.43 mm).

In view of the above description, it is likely that modifications and improvements will occur to those skilled in the art which are within the scope of this invention.

What is claimed is:

1. A pushbutton switch comprising:

a housing comprised partially of dielectric material;

a plurality of electrical terminals mounted in and projecting outwardly from one side of said housing;

a first contact member pivotably mounted within said housing, said first contact member having at least two operative positions and being adapted to selectively interconnect some of said terminals when in at least one of said operative positions;

a first insulative member mounted on and pivotable with said first contact member;

a leaf spring mounted within said housing and being shaped and configured to be normally in interference contact with said first insulative member;

a pivot pin extending downwardly within said housing and having an end adapted to selectively contact said first insulative member, said first insulative member being configured to receive said end of said pivot pin; and means for longitudinally moving said pivot pin into and out of engagement with said first insulative member;

whereby upon being moved longitudinally downwardly, said pivot pin engages said first insulative member so as to cause said first insulative member and first contact member to pivot to one operative position, said first insulative member being retained in said one operative position by interference contact with said leaf spring.

2. The switch recited in claim 1 wherein when said first contact member is in a first operative position it interconnects some of said terminals, and when said first contact member is in a second operative position it interconnects others of said terminals.

3. The switch recited in claim 2 wherein said means for moving said pivot pin comprises a plunger having one end projecting outwardly from another side of said housing, said plunger engaging said pivot pin for longitudinal motion therewith.

4. The switch recited in claim 3 wherein said housing comprises:

a bottom case of dielectric material;

an upper housing member mounted to said case; and a bushing secured to said upper housing member;

said plunger extending through said bushing and said terminals extending from said bottom case.

5. The switch recited in claim 1 wherein said plurality of terminals comprises:

at least one center terminal on which said first contact member pivots; and at least one end terminal spaced from said center terminal and adapted to be selectively interconnected to said center terminal by said first contact member when in one of said operative positions.

6. The switch recited in claim 5 wherein said center terminal extends farther into the interior of said housing than said end terminals, the inner end of said center terminal having a yoke configuration to receive said contact member.

7. The switch recited in claim 1 wherein:

said first insulative member is formed with a central upraised projection;

said leaf spring is formed with downwardly projecting dimples, said dimples being in interference contact with either side of said upraised projection.

8. The switch recited in claim 7 wherein said first insulative member is formed with surface depressions on either side of said upraised projection, said end of said pivot pin selectively engaging said depressions.

9. The switch recited in claim 7 wherein said leaf spring extends across the upper portion of said case and has sufficient flexibility to permit said upraised projection on said first insulative member to pass from one side to the other of said dimples while remaining in interference contact therewith.

10. The switch recited in claim 9 wherein said leaf spring is formed with a central elongated slot through which said end of said pivot pin is adapted to project when moved longitudinally downwardly.

11. The switch recited in claim 4 wherein said leaf spring is formed with oppositely disposed end tabs which are captured between said bottom case and said upper housing member, said leaf spring is further formed with downwardly projecting legs on either side of said tabs, said legs lying along the inside surface of said bottom case.

12. The switch recited in claim 4 and further comprising a slotted spring retainer extending across the bottom of said bushing, said end of said pivot pin extending through said slot in said spring retainer.

13. The switch recited in claim 3 and further comprising first spring means normally biasing said pivot pin away from said insulative member, whereby upon being released, said plunger and said pivot pin return to their normal position disengaged from said insulative member under the influence of said first spring means.

14. The switch recited in claim 8 wherein said leaf spring is formed with a central longitudinal slot through which said pivot pin extends when engaging said first insulative member.

15. The switch recited in claim 8 wherein:

said insulative member is formed with at least one blind hole extending into the upper surface thereof adjacent one of said depressions, said switch further comprising:

second spring means extending from said blind hole and engaging the upper inner surface of said housing, said second spring means biasing said insulative member and contact member to a first of said operative positions;

whereby upon moving said pivot pin longitudinally downwardly, said insulative member and contact member momentarily assume a second operative position and return to said first operative position upon release of said means for moving said pivot pin.

16. The switch recited in claim 1 wherein said switch is configured for double-pole, double-throw operation and comprises:

a second contact member pivotally mounted within said housing parallel to and adjacent said first contact member; and a second insulative member mounted on and pivotable with said second contact member;

said end of said pivot pin being T-shaped and adapted to contact said first and second insulative members substantially simultaneously;

said leaf spring being bifurcated, one side being in interference contact with said first insulative member and the other side being in interference contact with said second insulative member thereby retaining both said insulative members in one of said operative positions.

* * * * *